US007029064B2

(12) United States Patent
Chen

(10) Patent No.: US 7,029,064 B2
(45) Date of Patent: Apr. 18, 2006

(54) COLLAPSIBLE HIGH CHAIR FOR CHILDREN

(75) Inventor: Shun-Min Chen, Taipei Hsien (TW)

(73) Assignee: Wonderland Nurserygoods Co., Ltd., (TW)

( * ) Notice: Subject to any disclaimer, the term of this patent is extended or adjusted under 35 U.S.C. 154(b) by 289 days.

(21) Appl. No.: 10/623,981

(22) Filed: Jul. 21, 2003

(65) Prior Publication Data

US 2005/0017549 A1 Jan. 27, 2005

(51) Int. Cl.
*A47D 1/02* (2006.01)

(52) U.S. Cl. ..... 297/16.1; 297/328; 297/335

(58) Field of Classification Search ..... 297/16.1, 297/6, 313, 335–337, 326, 328
See application file for complete search history.

(56) References Cited

U.S. PATENT DOCUMENTS 2,973,804 A * 3/1961 Gill ..... 297/40
3,427,069 A * 2/1969 McDonald ..... 297/153
3,649,074 A * 3/1972 McDonald et al. ..... 297/327
4,768,825 A * 9/1988 Quinlan, Jr. ..... 297/39
4,968,092 A 11/1990 Giambrone
5,468,051 A * 11/1995 Huang ..... 297/344.18
5,489,138 A 2/1996 Mariol et al.
5,669,664 A * 9/1997 Perego ..... 297/327
6,161,898 A * 12/2000 Brevi ..... 297/16.1
6,203,102 B1 * 3/2001 Helmsderfer et al. ..... 297/335
6,347,833 B1 * 2/2002 Chen ..... 297/326

FOREIGN PATENT DOCUMENTS

DE 20218013 5/2003

* cited by examiner

*Primary Examiner*—Peter R. Brown
(74) *Attorney, Agent, or Firm*—Gauthier & Connors LLP

(57) ABSTRACT

A collapsible high chair for children comprises a frame, a seat portion, a backrest and an adjusting mechanism, all of which are sequentially connected with. The adjusting mechanism further comprises a pivotal member connecting the seat portion and the frame, a first engaging unit, and a second engaging unit. A sliding piece of the first engaging unit cooperates with two rods and makes the rods be escaped from the restriction of the pivotal member while a button of the second engaging unit cooperates with a cam and makes the cam be escaped from the restriction of the rib. Only when the rods and the cam are simultaneously escaped from the restriction of the pivotal member, the seat portion can be pivotally rotated relative to the frame. Also, the backrest can be rotated relative to the seat portion, so that the volume of the collapsed high chair is very small. Besides, the seat portion includes at least a movable piece with a bump for be engaged into the slits with different height at the arm of the seat portion to adjust the tray in height.

14 Claims, 9 Drawing Sheets

COLLAPSIBLE HIGH CHAIR FOR CHILDREN

FIELD OF THE INVENTION

The present invention relates generally to a collapsible high chair for children, and more particularly to a collapsible high chair whose seat portion can be pivotally rotated relative to a frame.

BACKGROUND OF THE INVENTION

As shown in FIG. 1, a conventional high chair 9' (or a stroller) mainly comprises a seat portion 1', a backrest 2', an arm 12', a frame 4' and a plurality of wheels 8', all of which are pivotally connected as well as a tray 3' being connected to the arm 12'. However, when the conventional high chair 9' is collapsed, only the inverse V-shaped frame 4' is collapsible into two parallel bars or the backrest 2' is adjustable to parallel with the frame 4'. However the angle between the seat portion 1' and the frame 4' can by no means be adjusted. Therefore, the front-rear seat portion 1', which is almost perpendicular to the frame 4', has a large longitudinal size. This not only results in lots of packing material being consumed but also too much transportation space being occupied, which increases the packing material and the transportation cost and moreover is inconvenient for users to carry outdoors.

On the other hand, the conventional high chair 9' only has a button (not shown) for collapsing the high chair 9'. Hence, if the button is mistakenly pressed or broken down, the infant in the high chair 9' may drop down or be jammed.

SUMMARY OF THE INVENTION

Accordingly, the present invention relates to a collapsible high chair for children that can substantially obviate one or more of the problems due to the limitations and disadvantages of the related arts.

One object of the present invention is the provision of a collapsible high chair for children whose volume after being collapsed is very small.

Another object of the present invention is the provision of a collapsible high chair for children which is convenient to be carried.

A further object of the present invention is the provision of a collapsible high chair for children whose packing and transportation costs are lower.

Another object of the present invention is the provision of a collapsible high chair for children, including a collapsing button, such that even if the button is mistakenly pressed or broken down, there is no risk of the infant in the high chair dropping down.

Additional features and advantages of the invention will be set forth in the description which follows, and in part will be apparent from the description, or may be learned by practice of the invention. The objectives and advantages of the invention will be realized and attained by the structure particularly pointed out in the written description and claims hereof as well as the appended drawings.

To achieve these and other advantages and according to the purpose of the present invention, as embodied and broadly described, a collapsible high chair for children comprises a seat portion, a backrest pivotally connected to the seat portion, a frame, and an adjusting mechanism connected to the seat portion and the frame. Said adjusting mechanism further comprises a pivotal member connected to the seat portion and the frame, and a first engaging unit. Said first engaging unit further comprises a sliding piece installed at the seat portion and a plurality of rods connected to the sliding piece and the pivotal piece, and fixing the seat portion at a predetermined angle relative to the frame. The sliding piece cooperates with the rods to make the rods be escaped from the restriction of the pivotal member and allow the seat portion to pivotally rotate relative to the frame for collapsing the high chair.

It is preferred that the rods comprise a first rod secured at the seat portion and at least a second rod movable in the first rod.

It is preferred that the first rod passes the sliding piece. The first engaging unit further has a plurality of connecting elements respectively passing through the sliding piece, the first rod, and at least the second rod to make the sliding piece cooperate with the second rod.

It is preferred that both the seat portion and the pivotal member respectively have a collar engaged with each other to serve as a pivot for the seat portion to pivotally rotate.

It is preferred that the adjusting mechanism further comprises a second engaging unit for connecting the seat portion and the pivotal member.

It is preferred that the pivotal member further has a collar in which a rib is provided for the second engaging unit to be engaged with.

It is preferred that the second engaging unit comprises a cam provided in a collar of the seat portion so as to be engaged with the rib of the pivotal member to prevent the seat portion from being pivotally rotated.

It is preferred that the second engaging unit further comprises a button installed at the pivotal member, so when the button is pressed down, the cam is escaped from the restriction of the rib and the seat portion is pivotally rotated relative to the frame in order to collapse the high chair.

It is preferred that the high chair further has a tray connected to the seat portion.

It is preferred that the seat portion further has at least an arm and at least a movable piece engaged with each other wherein the movable piece is connected to the tray for adjusting the tray in height.

It is preferred that the movable piece has a bump and the arm has a plurality of slits with different heights for the bump to respectively be engaged so as to adjust the tray in height.

It is preferred that the backrest can be pivotally rotated relative to the seat portion.

It is preferred that the pivotal member is movably fixed to the frame.

It is to be understood that both the foregoing general description and the following detailed description are exemplary, explanatory and are intended to provide further explanation of the invention as claimed.

BRIEF DESCRIPTION OF THE DRAWINGS

The accompanying drawings, which are included to provide a further understanding of the invention are incorporated in and constitute a part of the specification, illustrate embodiments of the invention and together with the description serve to explain the principle of the invention. In the drawings.

DETAILED DESCRIPTION OF THE INVENTION

Figure 1:
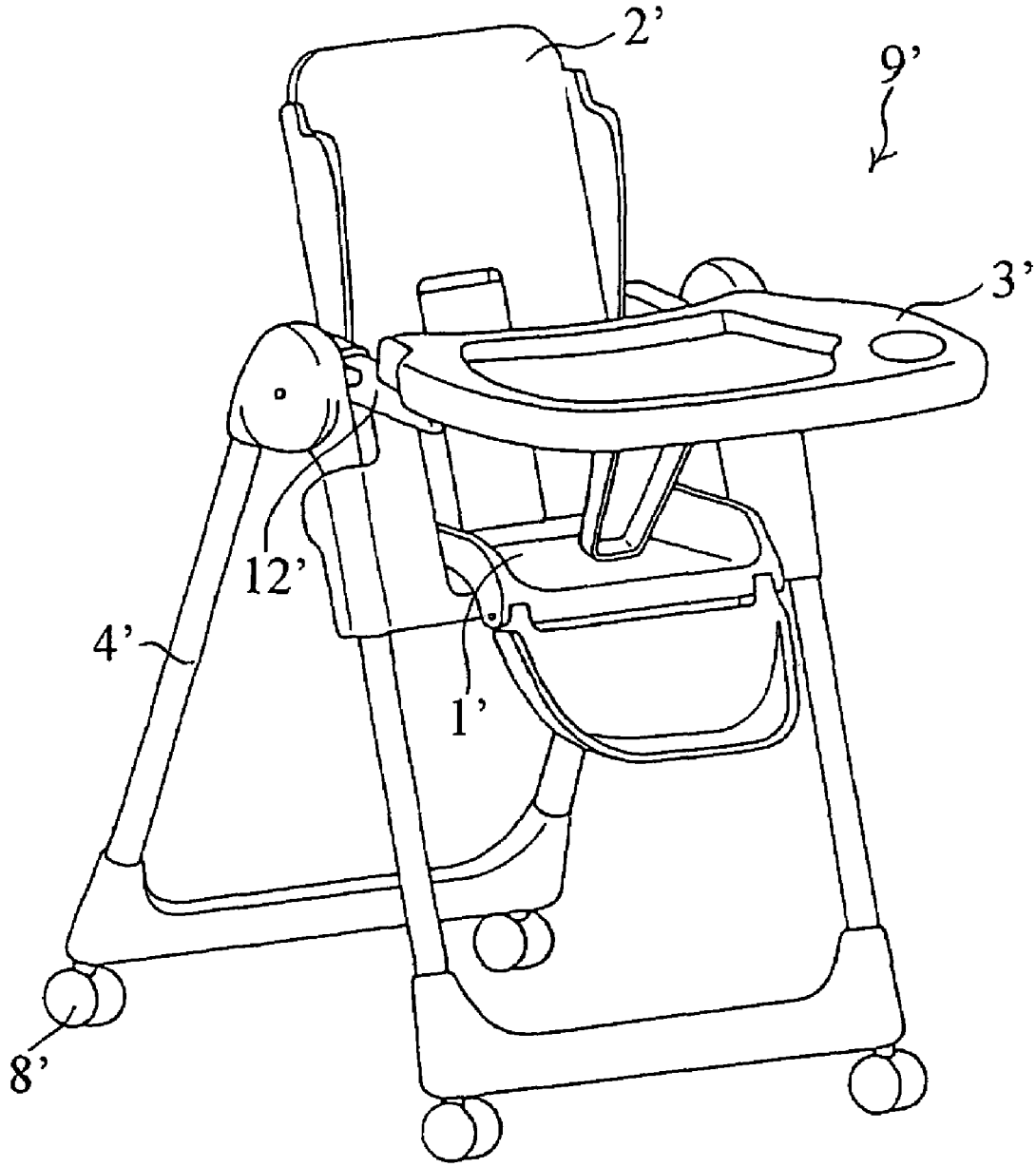
FIG. 1 is an assembled perspective view illustrating a conventional high chair.
Figure 2:
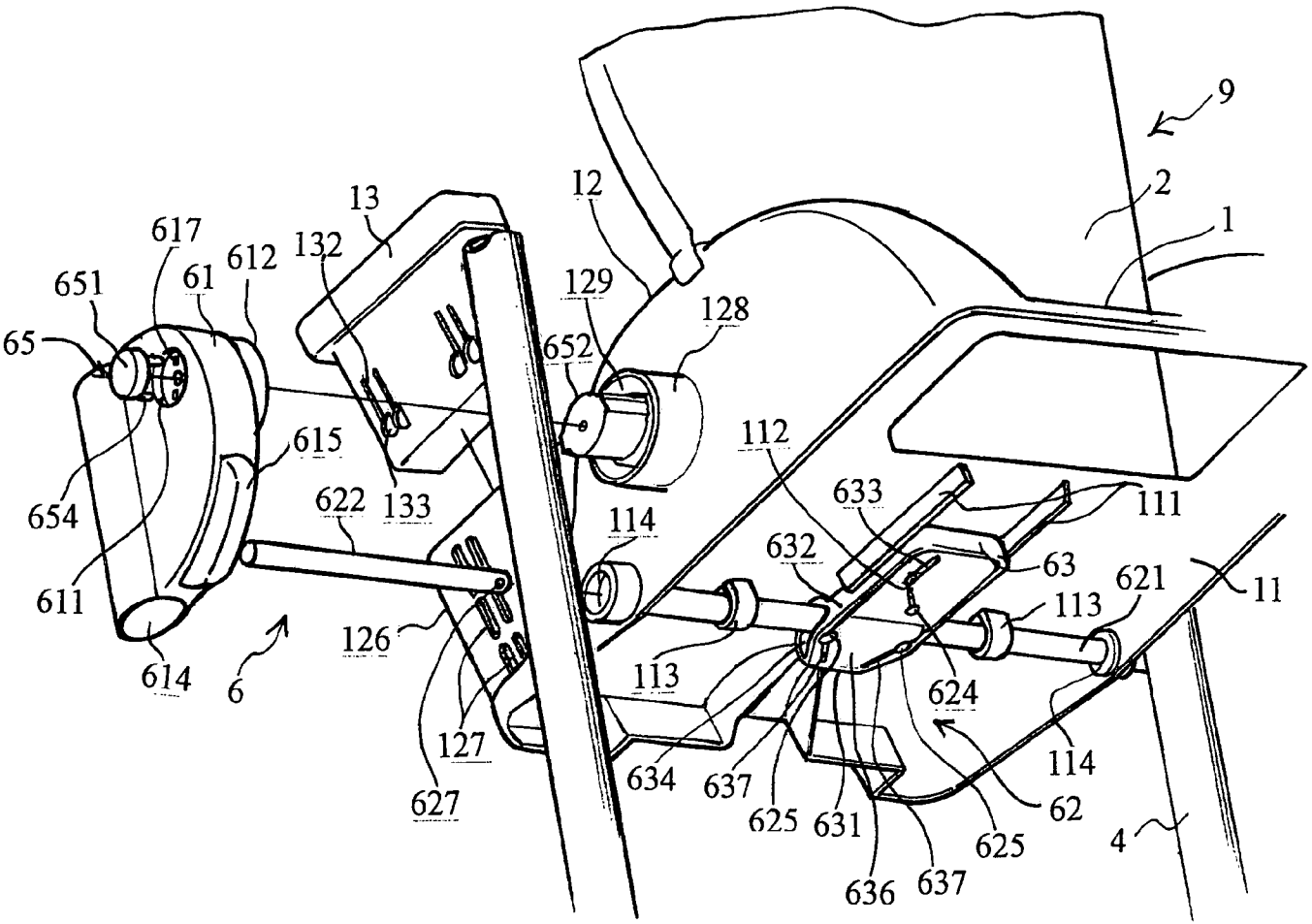
FIG. 2 is a partially exploded perspective view illustrating the elements of an adjusting mechanism of a collapsible high chair according to the present invention.
Figure 3:
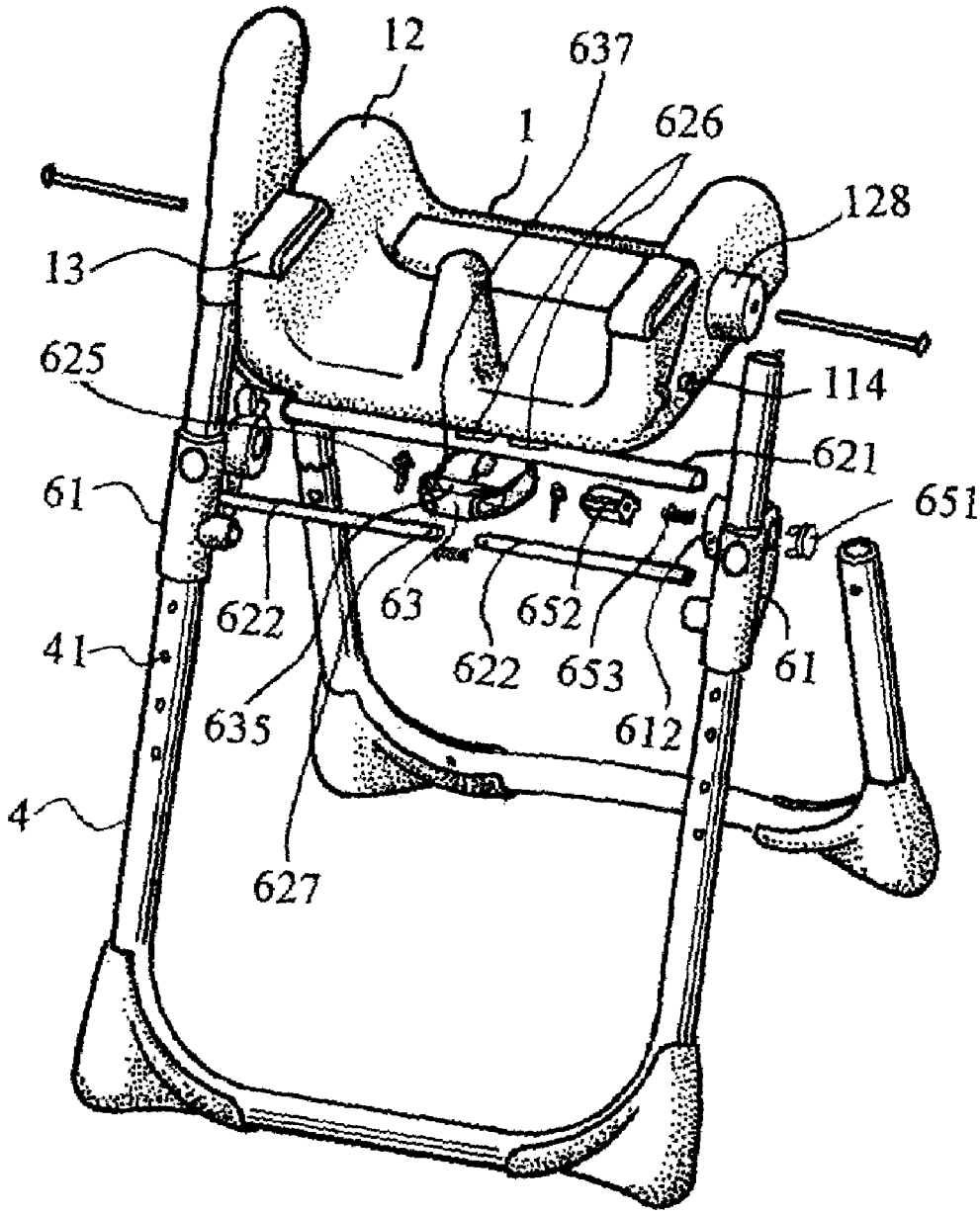
FIG. 3 is another partially exploded perspective view similar to FIG. 2.
Figure 4:
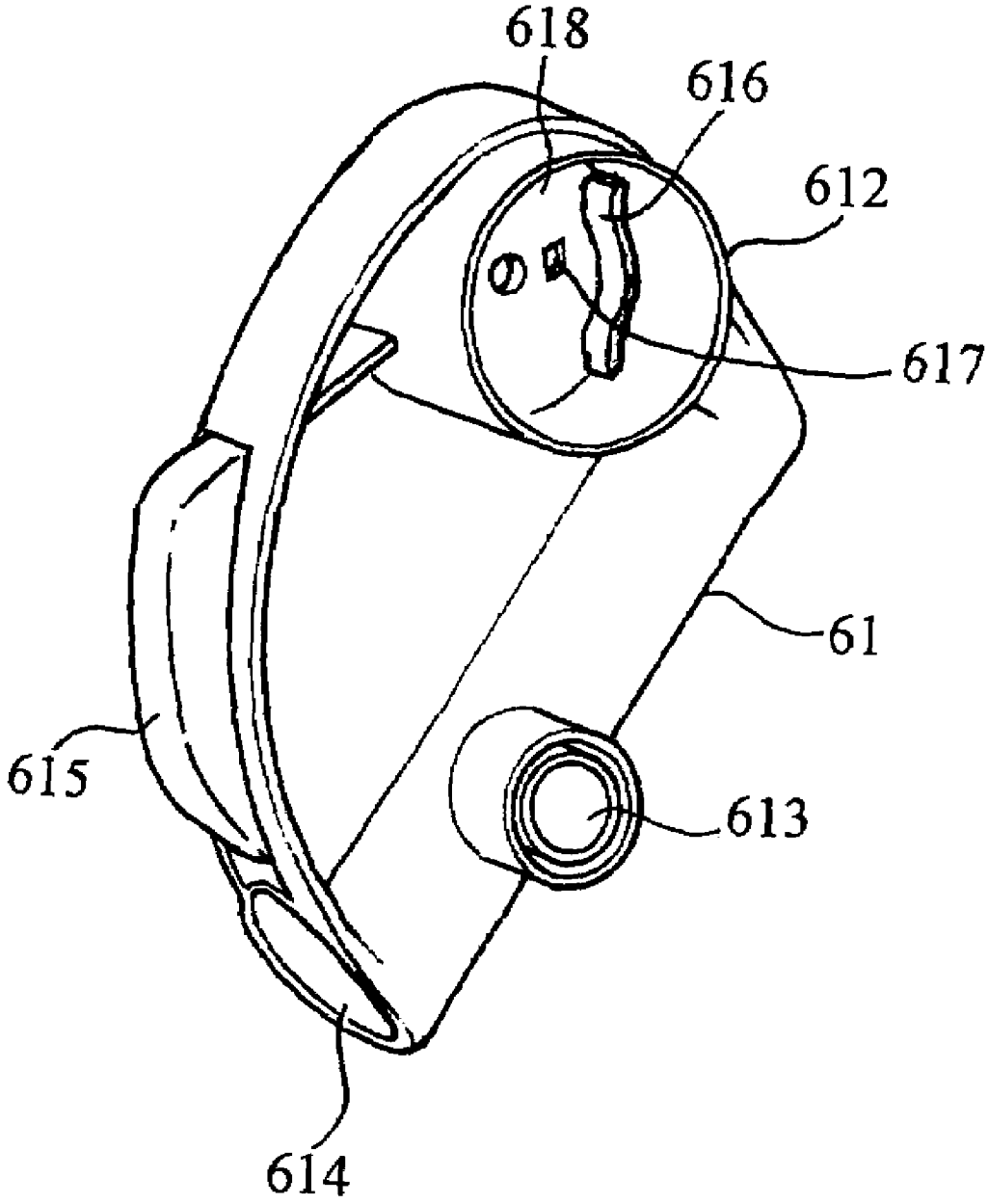
FIG. 4 is a perspective view of a pivotal member of the collapsible high chair according to the present invention.
Figure 5:
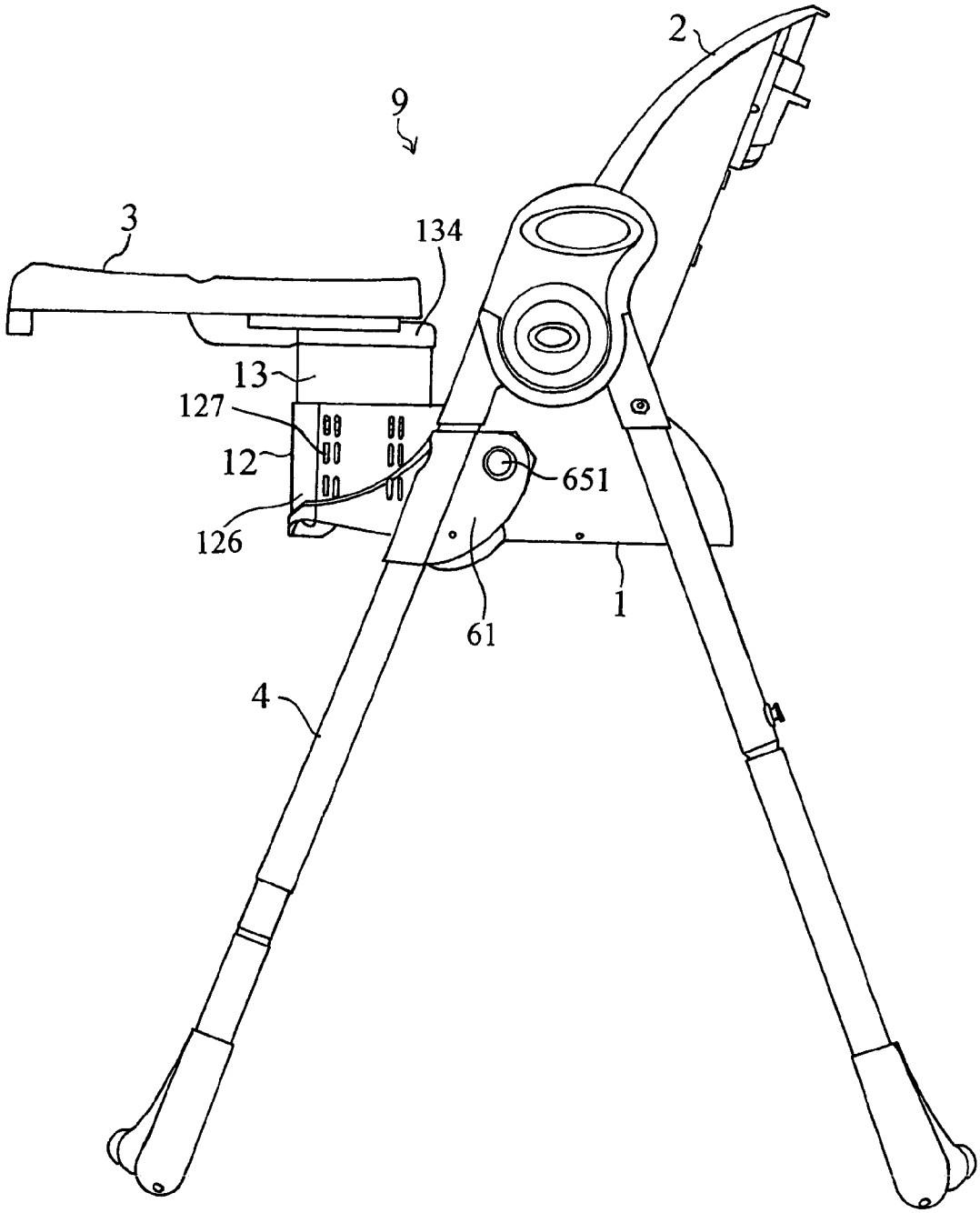
FIG. 5 is an assembled side view of the collapsible high chair according to the present invention.

The 'rod' in the present invention includes solid rod and hollow tube.

As shown in FIGS. 2, 3, 4 and 5, a collapsible high chair for children 9 according to the present invention comprises a seat portion 1, an upwardly extending backrest 2 pivotally connected to the rear part of the seat portion 1 at two sides, a tray 3 for being placed articles thereon connected onto front part of the seat portion 1 at two sides, a downwardly extending frame 4 pivotally connected to the middle part of the seat portion 1 at two sides, and an adjusting mechanism 6 installed at the bottom surface of the seat portion 1 and laterally extending to engage with the frame 4 at two sides, wherein the prior art can be adopted as the pivotally connecting structure and the adjusting structure of inclination between the seat portion 1 and the backrest 2, so that there is no further description thereof hereinafter.

The seat portion 1 comprises a tabular seat plank 11, two arms 12 upwardly extending respectively from two sides of the seat plank 11, and two T-shaped movable pieces 13 partially accommodated respectively in the arms 12.

The seat plank 11 has two longitudinal costas 111 in parallel extending from the bottom surface thereof at central part, an annular stake 112 downward between two costas 111, two lateral rings 113 respectively provided outside of two costas 111 and at the front part of the seat plank 11, two holes 114 formed at two lateral sides and aligned with two rings 113.

Each arm 12 respectively has a female collar 128 outwardly and perpendicularly extending from the outer wall thereof at the center part and a beehive-shaped ledge 129 in the female collar 128. A shell 126 with an upward opening is formed at the front half section of each arm 12. Four column of slits 127, three in each column, are juxtaposed on outer wall of each shell 126 and four slits 127 laterally aligned with each other are constructed a group. Two laterally parallel flexible fingers 132, each with two round bumps 133 at lower end thereof, are integrally molded at lower section of each movable piece 13.

The top end 134 of each movable piece 13 is engaged with the bottom end of the tray 3 and the lower section of each movable piece 13 is accepted in the shell 126 of each arm 12. By means of the four bumps 133 being engaged into one group of slits 127 formed on the shell 126, the tray 3 is secured at a predetermined height above the the arm 12. When the bumps 133 are pressed from outside to inside by one hand, the bumps 133 are retracted into the shell 126 due to elastic deformation of the flexible fingers 132. At the same time, the movable pieces 13 are pulled up or pushed down by another hand and then by means of elastic deformation of the flexible fingers 132, the bumps 133 are engaged into another group of slits 127 to secure the tray 3 at a predetermined height above the arms 12 in order to achieve the object of adjusting the tray in height for being adapted to all infants or children with different statures. When the bumps 133 are engaged into the lowest group of the slits 127, the high chair 9 is adapted to be folded at this state so as to reduce the volume after being collapsed. Besides, the tray 3 can be further separated from the movable pieces 13 to make the volume of the collapsed high chair 9 smaller.

The adjusting mechanism 6 comprises two semicircle-like pivotal members 61, a first engaging unit 62, and a second engaging unit 65.

One of pivotal members 61 includes a circular recess 611 equipped at the upper part of the outer side wall thereof, a male collar 612 laterally extending from inner side wall thereof and aligned with the recess 611, a notch 613 provided at lower part of inner side wall thereof, a longitudinal thimble 614 configured at the diameter of the semicircle, a key 615 installed at the circumference of the semicircle. In addition, at least a round rib 616 extends from the bottom 618 of the male collar 612 near the edge as well as two rectangular openings 617 are formed on the bottom, aligned with the same diameter, and reached to the recess 611. However, another pivotal member 61 only has the male collar 612, notch 613, thimble 614 and key 615 but does not have the recess 611, rib 616 and openings 617.

The second engaging unit 65 comprises a circular button 651, a beehive-shaped cam 652, and a second elastic element 653. The button 651, at two sides, respectively has a tab 654 with a barb 655 (shown in FIG. 6) at distal end thereof.

Press the key 615 of the pivotal member 61 to retract the tenon (not shown) extending into the thimble 614 and then push the thimble 614 of the pivotal member 61 around the frame 4. Slide the pivotal member 61 to a predetermined height and then stop pressing the key 615 to make the tenon engage one of apertures 41 of the frame 4. Another pivotal member 61 without the rib 616 is pushed around the frame 4 on the other side in the same way.

Sequentially mount the second elastic element 653 of the second engaging unit 65 and the cam 652 into the ledge 129 at one side of the seat portion 1. On the other hand, make the two tabs 654 of the button 651 penetrate the pivotal member 61 through the opening 617. Then, in the manner of abutting the outer surface of the cam 652 against the side surface of the ledge 129, push the female collar 128 of the seat portion 1 into the male collar 612 of the pivotal member 61. Due to the exertion of restoration force of the second elastic element 653, the cam 652 will be always kept at the most projective position so that the outer side surface near the front end of the cam 652 is also always abutted against the side of the rib 616, together with the rear end of the cam 652 being restricted by the ledge 129, which provides the function of preventing the seat portion 1 from rotating relatively to the pivotal member 61. Besides, the barbs 655 of the button 651 grapple the male collar 612 at the bottom 618 thereof and hence it is difficult for the button 651 to be escaped from the pivotal member 61.

The first engaging unit 62 includes a hexagonal sliding piece 62 integrally formed, a first rod 621, two second rods 622 accommodated in the first rod 621 together with a first elastic element 623, a first connecting element 624, and at least a second connecting element 625.

The sliding piece 63 includes a trapezoid section 631 at the front part and a rectangular section 632 at the rear part. The rectangular section 632 has a longitudinal slot 633 at central part thereof. The hollow trapezoid section 631 has two passages 634 respectively at two inclined planes and four elongated holes 637 with two respectively at the upper wall 635 and lower wall 636 and each near one inclined plane. The front ends of two elongated holes 637 at the same wall 635 or 636 are closer than the rear ends thereof.

The first rod 621 has four flutes 626 in all with two laterally juxtaposed at one side and another two at another side respectively aligned on the same diameter. Each second rod 622 has two eyelets 627 aligned on the same diameter of one end thereof.

Put the sliding piece 63 of the adjusting mechanism 6 between two costas 111 and make the annular stake 112 of the seat portion 1 insert into the slot 633 of the sliding piece 63. Then screw a first connecting element 624 such as a screw into the annular stake 112 to movably restrict the sliding piece 63 at the bottom of the seat plank 11. Next, pass the first rod 621 through the holes 114, the rings 113 of the seat plank 11, and the passages 634 at two sides of the trapezoid 631 of the sliding piece 63 in sequence in order to secure the first rod to the bottom of the seat plank 11. Sequentially, after installing the first elastic element 623 into the first rod 621, two second rods 622 are inserted into the first rod 621 respectively from two holes 114 in the manner that the ends with the eyelets 627 are faced each other. Furthermore, pass two second connecting elements 625 such as rivets respectively through two elongated holes 637 at the upper wall 635 of the trapezoid section 631 of the sliding piece 63, two flutes 626 juxtaposed laterally at one side of the first rod 621, the eyelets 627 of two second rods 622, another two flutes 626 at another side of the first rod 621, and two elongated holes 637 at the lower wall 635 of the trapezoid section 631 of the sliding piece 63 as well as simultaneously make the ends without eyelets 627 of two second rod 622 respectively protrude out of the seat plank 11 at two sides thereof so as to be engaged into the notches 613 of two pivotal members 61 as a result of fixing the seat portion 1 with the frame 4.

Figure 6:
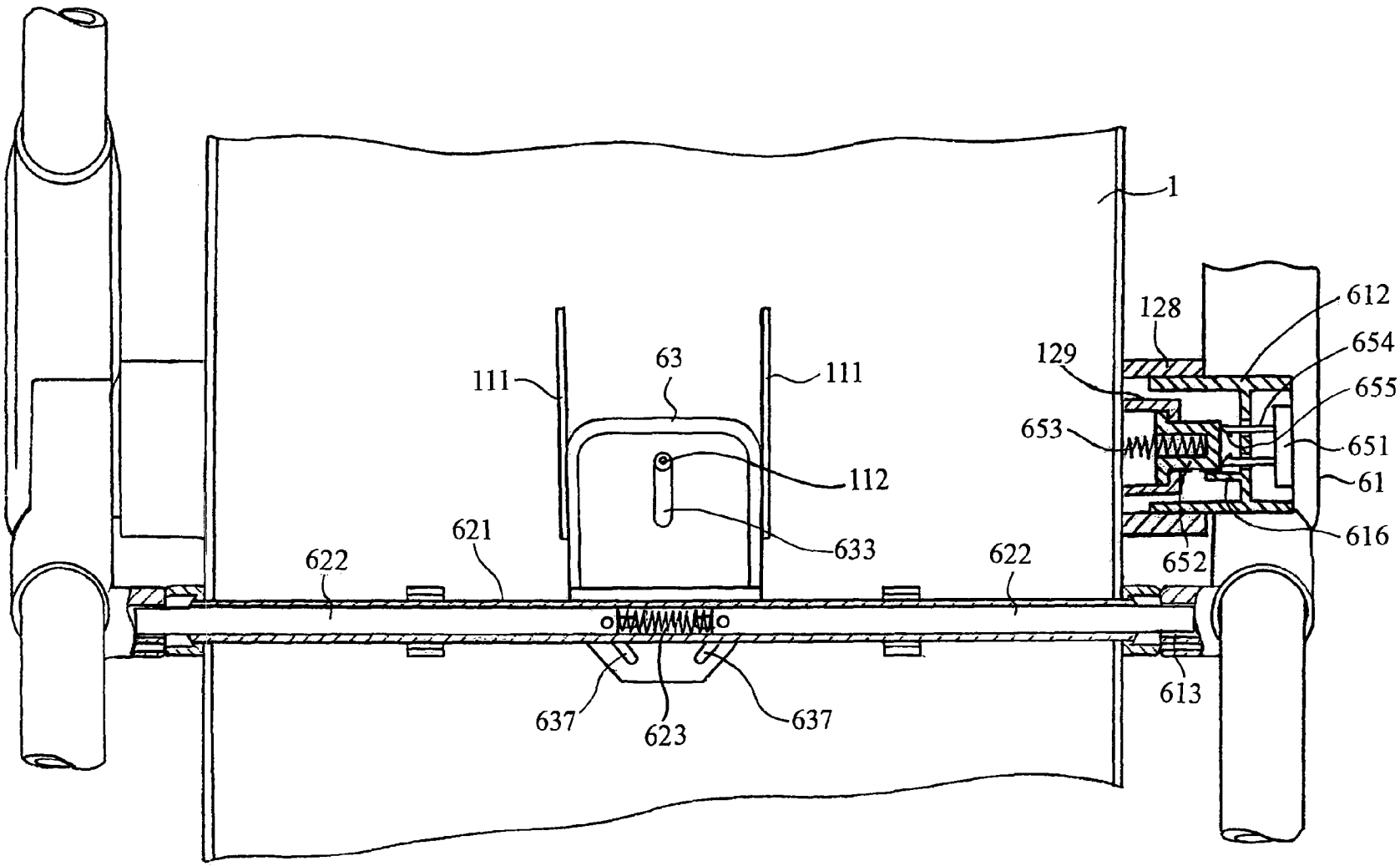
FIG. 6 is a partially sectional bottom view of the collapsible high chair according to the present invention illustrating both engaging states of a first engaging unit and a second engaging unit.

Incorporating FIG. 6 into reference, the above description is related to the stretched state of the high chair 9 for children according to the present invention wherein two second rods 622 are engaged into the notches 613 of the pivotal members 61 and the cam 652 of the second engaging unit 65 is abutted against the rib 616 of the pivotal member 61. By the way of fixing the seat portion 1 at two points on each side, the seat portion 1 can be firmly secured to the frame 4 without the risk of turning over.

Figure 7:
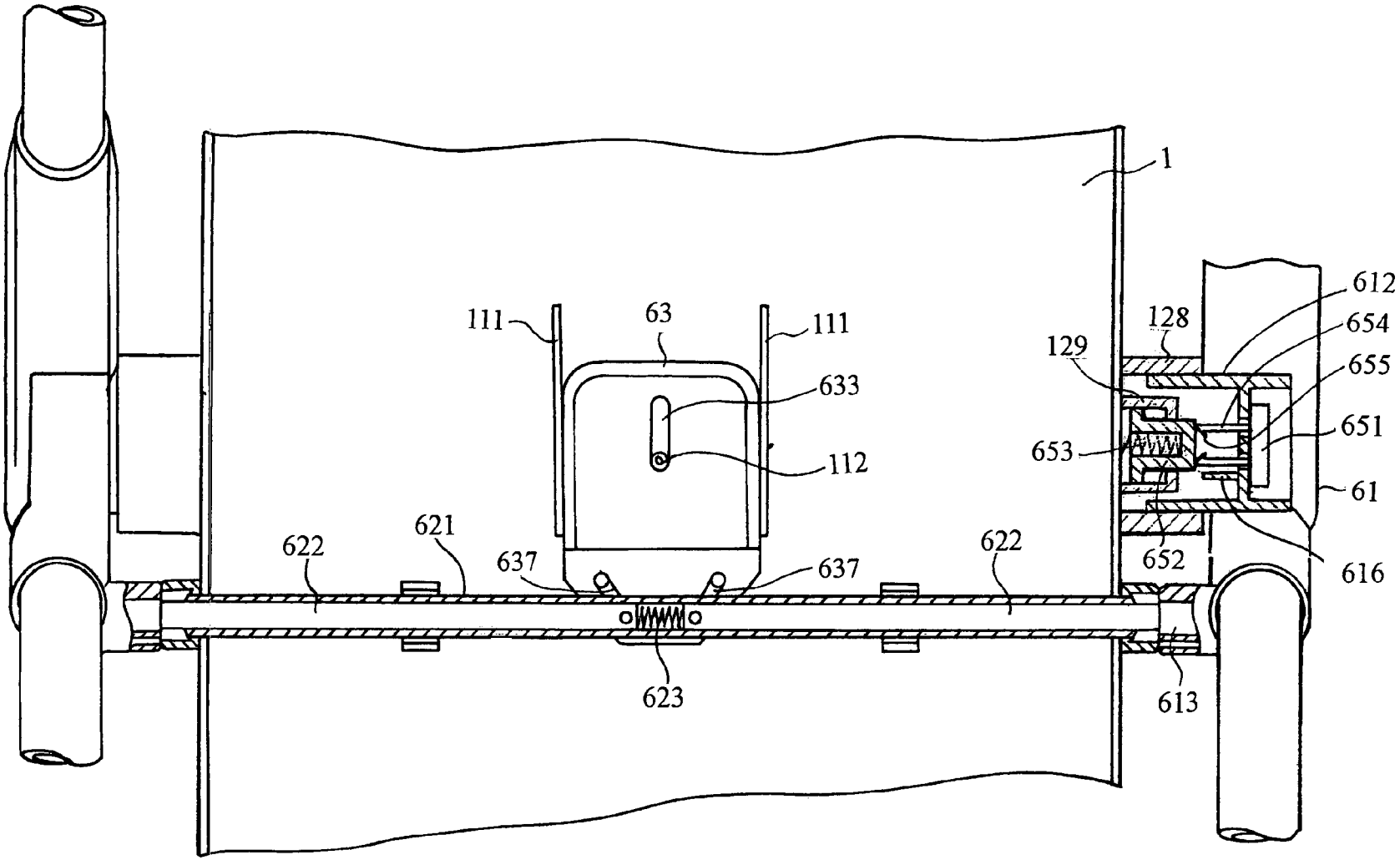
FIG. 7 is similar to FIG. 6 by illustrating both unengaged states of a first engaging unit and a second engaging unit.

Incorporating FIG. 7 into reference, when folding the high chair for children is desired, pull with one hand backwardly the sliding piece 63 which backwardly slides under the guide of the annular stake 112 and costas 111 at the bottom of the seat plank 11. Because the second connecting elements 625 are restricted from front-rear longitudinal movement by the first rod 621, two second connecting elements 625 move respectively from the rear ends to the front ends of four elongated holes 637 when the sliding piece 63 moves backwardly. Further because two lateral elongated holes 637 are not parallel with each other, that is, the distance between two rear ends of two lateral elongated holes 637 is larger than that of two front ends thereof, when two second connecting elements 625 respectively move from the rear ends to the front ends of two elongated holes 637, the lateral distance between two second connecting elements 625 is shortened at the same time and two second rods 622 are cooperated to move near each other. The movement of two second rods 622 results in compressing the first elastic element 623 on one hand, and on the other hand retracting two second rods 622, which protrude out of two sides of the seat plank 11, to escape from the notches 613 and get rid of the restriction of the pivotal members 61. However, the cam 652, which cannot be rotated, is still abutted by the rib 616 of the pivotal member 61 so that the seat portion 1 cannot be pivotally rotated relatively to the frame 4 yet.

When the sliding piece 63 of the first engaging unit 62 is pulled backward by one hand, and the button 651 of the second engaged unit 65 is pushed simultaneously by another hand, the cam 652 is pushed into the interior of the arm 12 by the front ends of the tabs 654 of the button 651 to the extent that the cam 652 is beyond the end surface of the rib 616 and escapes the cam 652 from the restriction of the rib 616 to thus permit the seat portion 1 being rotated relative to the frame 4 and the female collar 128 and male collar 612 engaged with each other function as a pivot.

The sliding piece 63 is designed to release the engagement of seat portion 1 and pivotal member 61 to make the seat portion 1 pivotally rotatable when it is desired for the high chair 9 to be collapsed. However, if the high chair 9 for children is only provided with a first safety lock, comprising sliding piece 63 and second rods 622 to limit the seat portion 1 from rotating, the rotatable seat portion 1 will make the infant therein drop down or moreover be hurt when sliding piece 63 is mistakenly pulled resulting in the second rods 622 being escaped out of the notches 613 of the pivotal member 61. Accordingly, the second engaging unit 65 with the cam 652 unable to rotate can serve as a secondary safety lock. On the contrary, when the high chair 9 is in the state of being stretched and the sliding piece 63 of the first safety lock is engaged at its normal position, even the button 651 of the secondary safety lock is mistakenly pressed, the seat portion 1 still does not have the risk of rotating relative to the frame 4 since there are two connecting points therebetween in that the second rods 622 of the first safety lock and the female collar 128 of the seat portion 1 (near the secondary safety lock) are respectively engaged in the notches 613 and male collar 612 of pivotal member 61. Therefore, the high chair 9 according to the present invention is very safe in the state of being stretched when used and can avoid the infant therein from dropping down or being hurt when one of the engaging units 62, 65 breaks down or is mistakenly operated.

Figure 8:
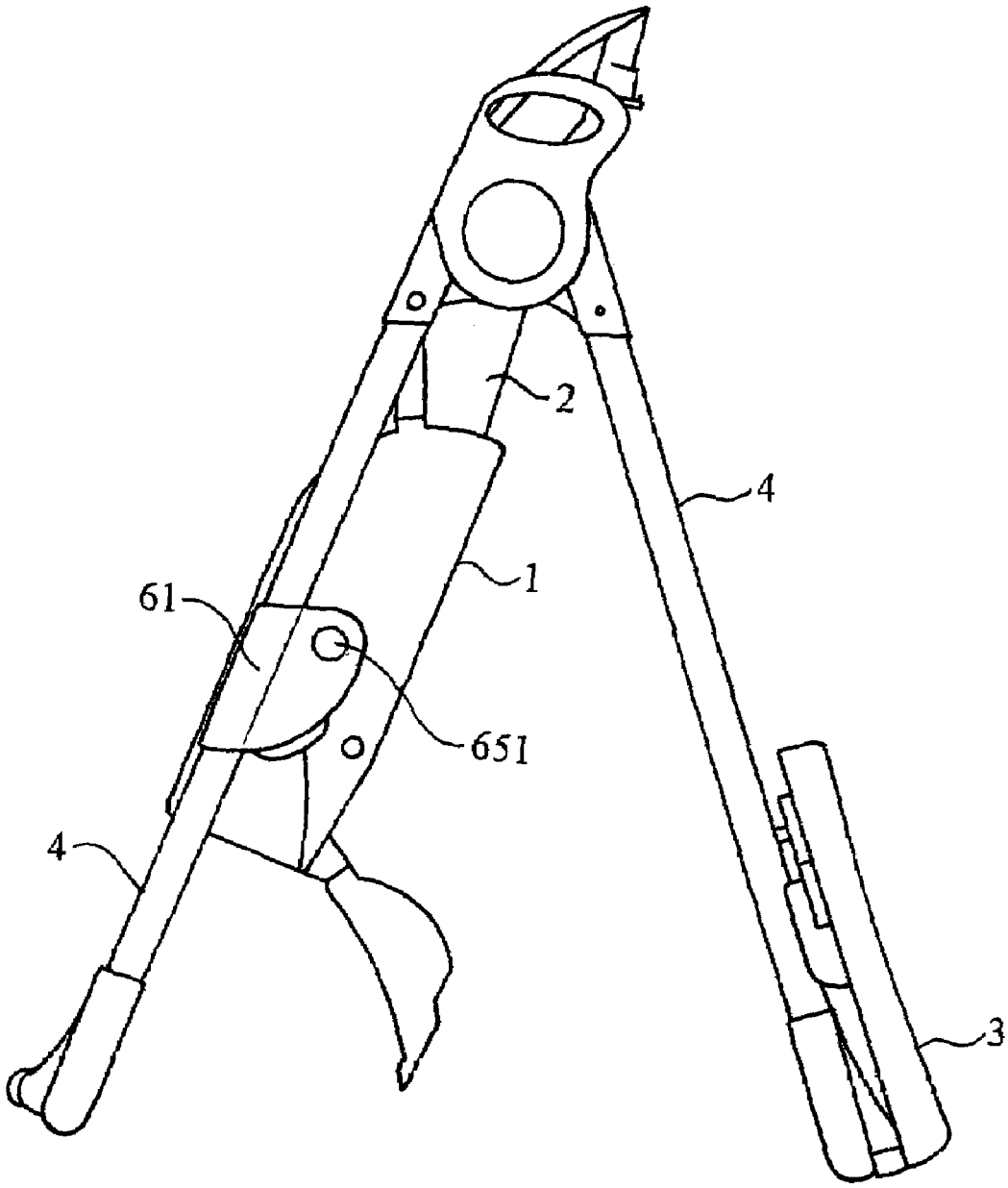
FIG. 8 is a side view of the collapsible high chair according to the present invention illustrating the high chair is in a half-collapsed state.
Figure 9:
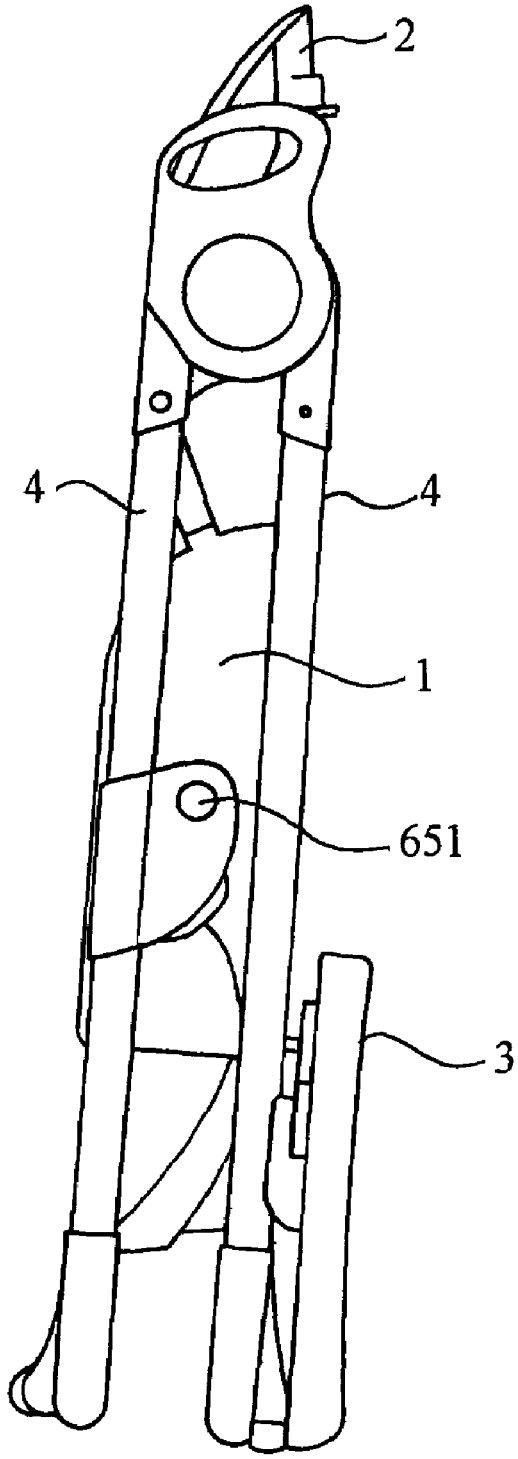
FIG. 9 is similar to FIG. 8 but in a completely collapsed state.

As shown in FIGS. 8 and 9, when it is desired to fold the high chair 9, at first, the movable piece 13 is adjusted to the lowest position or the tray 3 is further separated from the movable piece 13. Next, the backrest 2 is pivotally rotated backward to have about 180 degrees relative to the seat portion 1, which can be achieved by a conventional mechanism. Then, the sliding piece 63 is pulled backward with one hand to the extent that the second rods 622 are respectively escaped from the notches 613 of the pivotal members 61. Simultaneously, the button 652 is pressed with another hand to the extent that the cam 652 is escaped from the rib 616. At this time, the seat portion 1 can be forward rotated about 90 degrees to make both the seat portion 1 and the backrest 2, having about 180 degrees therebetween, parallel with the frame 4 so as to reduce front-rear size in width of the high chair 9 after being collapsed. Sequentially, the keys 615 of the pivotal members 61 are pressed and the pivotal members 61 are slid down along the frame 4 to low down both the seat portion 1 and backrest 2 in order to reduce up-down size in height of the high chair 9 after being collapsed. Consequently, the volume of the high chair 9 after being collapsed is very small, which is not only convenient for users to carry with outdoors but also largely reduces packing material needed to be consumed for the manufacturers. Besides, transportation cost is down because space occupied on the transportation means is decreased.

When it is desired to stretch and use the high chair 9 from the collapsed state of the present invention, the reverse sequential steps can be adopted and operated. At the meantime, while the seat portion 1 is pivotally rotated to almost parallel with ground, the cam 652 is pushed out by restoration force of the second elastic element 653 and is engaged into the bottom 618 of the male collar 612 of the pivotal member 61 as well as is abutted by the side surface of the rib 616. After the sliding piece 63 is released from the hand, the second rods 622 are outward pushed into the notches 613 of the pivotal member 61 to secure and position the seat portion 1 at the state of be stretched by the restoration force of the first elastic element 623 in the first rod 621.

This invention has been disclosed in terms of specific embodiments. It will be apparent that many modifications can be made to the disclosed structures without departing from the invention. Therefore, it is the intent of the appended claims to cover all such variations and modifications that are within the true sprit and scope of this invention.

What is claimed is:

1. A collapsible high chair for children, comprising:

a seat portion;

a backrest pivotally connected to the seat portion;

a frame; and an adjusting mechanism which connects to the seat portion with the frame;

said adjusting mechanism further comprising:

a pivotal member which is located on the frame and also connects with the seat portion at a first potion and a second potion of the pivotal member; and a first engaging unit which is located on the seat portion;

said first engaging unit further comprising:

a sliding piece installed on the seat portion;

a plurality of rods slidably engaged with the pivotal member at the first portion and fixing the seat portion at a predetermined angle relative to the frame when engaged with the pivotal member;

wherein the sliding piece cooperates with the rods to allow the rod to be disengaged from the pivotal member when collapsing the high chair and allow the seat portion to pivotally rotate relative to the frame about the second portion.

2. The collapsible high chair for children as claimed in claim 1, wherein the rods comprise a first rod secured at the seat portion and at least a second rod movable in the first rod.

3. The collapsible high chair for children as claimed in claim 2, wherein the first rod passes through the sliding piece and the first engaging unit further has a plurality of connecting elements respectively passing through the sliding piece, the first rod, and the at least second rod to make the sliding piece cooperate with the at least the second rod.

4. The collapsible high chair for children as claimed in claim 1, wherein both the seat portion and the pivotal member respectively have a collar engaged with each other to serve as a pivot for the seat portion to pivotally rotate.

5. The collapsible high chair for children as claimed in claim 1, wherein the adjusting mechanism further comprises a second engaging unit situated at the second portion for connecting the seat portion and the pivotal member.

6. The collapsible high chair for children as claimed in claim 5, wherein the pivotal member further has a collar at the second portion, in which a rib is provided for the second engaging unit to be engaged with.

7. The collapsible high chair for children as claimed in claim 6, wherein the second engaging unit comprises a cam provided in a collar of the seat portion so as to be engaged with the rib of the pivotal member to prevent the seat portion from being pivotally rotated.

8. The collapsible high chair for children as claimed in claim 7, wherein the second engaging unit further comprises a button which is installed in the pivotal member and contacts with the cam, wherein when the button is pressed, the cam is released from the engagement of the rib, and the seat portion is able to pivotally rotated relative to the frame in order to collapse the high chair.

9. The collapsible high chair for children as claimed in claim 1 or 5, wherein the high chair further has a tray connected to the seat portion.

10. The collapsible high chair for children as claimed in claim 9, wherein the seat portion further has at least an arm and at least a movable piece engaged with each other and at least the movable piece is connected to the tray for adjusting the tray in height.

11. The collapsible high chair for children as claimed in claim 10, wherein the movable piece has a bump and the arm has a plurality of slits with different heights for the bump to respectively be engaged into so as to adjust the tray in height.

12. The collapsible high chair for children as claimed in claim 9, wherein the backrest can be pivotally rotated relative to the seat portion.

13. The collapsible high chair for children as claimed in claim 1, wherein the height of the pivotal member on the frame can be adjusted.

14. The collapsible high chair claimed in claim 13, wherein the frame has a plurality of apertures situated at different heights, and the pivotal member is provided with a tenon which is optionally positioned in one of the apertures to adjust the height of the pivotal.

* * * * *